US006474023B1

(12) United States Patent
Takeuchi

(10) Patent No.: US 6,474,023 B1
(45) Date of Patent: Nov. 5, 2002

(54) SEATING TIERS FOR STADIUMS AND THE LIKE

(76) Inventor: Arthur S. Takeuchi, 5542 S. Harper Ave., Chicago, IL (US) 60637-1830

( * ) Notice: Subject to any disclaimer, the term of this patent is extended or adjusted under 35 U.S.C. 154(b) by 0 days.

(21) Appl. No.: 10/051,822

(22) Filed: Jan. 17, 2002

(51) Int. Cl.[7] ..... E04H 3/12; E04H 3/10
(52) U.S. Cl. ..... 52/8; 52/6; 472/92
(58) Field of Search ..... 52/8, 6; 472/92

(56) References Cited

U.S. PATENT DOCUMENTS 1,397,064 A * 11/1921 Togersen
1,795,331 A * 3/1931 Davidson

FOREIGN PATENT DOCUMENTS

SU 653-370 * 3/1979

* cited by examiner

*Primary Examiner*—Carl D. Friedman
*Assistant Examiner*—Kevin McDermott
(74) *Attorney, Agent, or Firm*—Van Metre Lund

(57) ABSTRACT

Seating tiers are used in a stadium to position rows of spectators at progressively higher levels, the tiers having a reverse slope such that each row is closer to a playing field than the next lower row, thereby providing spectators with an excellent view of action on the field. Walkways extend along the fronts of the seats and windows are adjacent the walkways to allow viewing of the field while protecting spectators. Cross-beams support the rows of seats and provide the walkways and are supported between stairway units that are part of a supporting frame structure.

19 Claims, 7 Drawing Sheets

SEATING TIERS FOR STADIUMS AND THE LIKE

BACKGROUND OF THE INVENTION

1. Field of the Invention

This invention relates to seating tiers. The tiers of the invention greatly facilitate viewing by spectators, provide increased seating capacity, reduce required heights and horizontal dimensions and have many other advantages. They are especially designed for use in a stadium usable as a football stadium but can adapted for use in a variety of applications including theaters and concert halls and stadiums used for basketball, soccer, hockey and track and field activities 2. Description of the Prior Art The seating tiers of stadiums and theaters and of halls used for concerts and other purposes are generally sloped back away from the field, stage or other region to be viewed. Higher tiers have increased slopes. In certain theaters, seats have been provided in boxes which are supported one above another.

SUMMARY OF THE INVENTION

This invention was evolved with the specific object of designing a new football stadium for the Chicago Bears team but has resulted in seating tier constructions which are usable in a variety of applications.

An important aspect of the invention is in a recognition of the problems involved. A preferred location for a new stadium for the Chicago Bears is Soldier Field because of its location along the Chicago lakefront and because the Bears have been playing there for years. Soldier Field was built in the 1920's to honor the soldiers of World War I and has distinctive colonnades and other architectural features which are well known and which have landmark status. A serious problem is that conventional designs are not suitable. Higher tiers would not only project upwardly to a level substantially higher than the colonnades but in doing so would project away from the playing field to hover over the colonnades and create an appearance which, to many people, would be an eyesore. Any new stadium built in the present location of Soldier Field and which projects upwardly beyond the colonnades would be objectionable to a great many people. It has also been. recognized that the unsuitability of conventional designs arises because tiers thereof must slope outwardly from the playing field with slopes that increase with height.

In an effort to solve these problems, consideration was given to providing a reverse slope in a highest tier, having it slope upwardly and toward the field from an outer end away from the field. In analyzing this possibility it was found that it could be usable with the proper design. In particular, it was found that with proper openings for viewing of the field, rows of seats for spectators could be supported at progressively higher levels and with each row other than the lowermost row being closer to the field than the next lower row. It was also discovered that spectators would thereby be provided with superior viewing points, especially for viewing actions in a football game. The reverse slope design can also be used to increase seating capacity while also reducing overall height and horizontal dimensions. Also, with specific regard to the Soldier Field problem, the proposed reversely sloped tiers will be at their highest at points toward the playing field and away from the colonnades, avoiding the visual hovering problems involved in using conventional designs.

Important features of the invention relate to the provision of walkways along the fronts of rows of seats, the provision of windows adjacent the walkways, the provision of stairways and designs of components to obtain high strength and safety while facilitating construction at low costs.

Cross-beams are provided for supporting rows of seats and are supported between stairway units that include lower step-defining portions, upper portions and connecting web portions. Windows are supported between adjacent cross-beams. Handrails are supported from the web portions of the stairway units and from the cross-beams.

Two stadium embodiments are disclosed. One is open. The other has an enclosing roof structure supported between the reversely sloped tiers of the invention.

In both stadium embodiments, a protective support structure may be provided that underlies the playing field and supports for all tiers and that is impervious to flow of water therethrough, being effective to transmit to the tier supports and hydraulic forces that may be applied to the underside of the protective structure. This allows the playing field to be located below water table.

The invention contemplates other objects, features and advantages which will become more fully apparent from the following detailed description taken in conjunction with the accompanying drawings.

BRIEF DESCRIPTION OF THE DRAWING FIGURES

DESCRIPTION OF PREFERRED EMBODIMENTS

Figure 1:
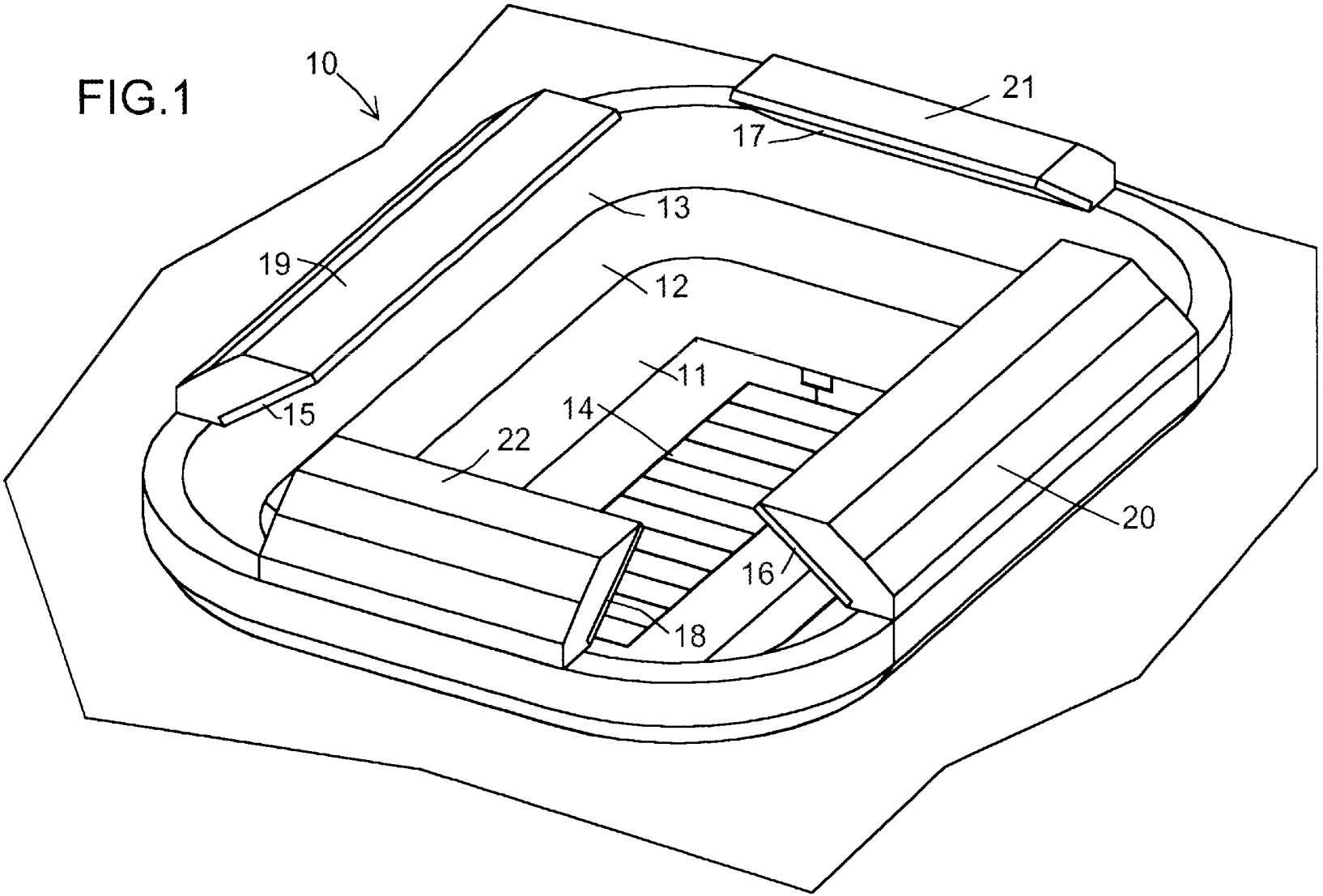
FIG. 1 is a isometric view of a stadium constructed in accordance with the invention.

Reference numeral 10 generally designates a football stadium constructed in accordance with the invention. The stadium 10 is designed with the objectives of minimizing height above ground level, minimizing overall horizontal dimensions, obtaining a high seating capacity and facilitating viewing by spectators.

As shown in FIG. 1, the stadium 10 includes three tiers 11, 12 and 13 of seats which surround a football field 14. The tiers 11, 12 and 13 are of conventional form in that they are at progressively higher levels, each being sloped upwardly and away from the center of the field 14. An uppermost fourth tier is provided by four reversely sloped "flying tier" seating structures 15, 16, 17 and 18. Structures 15 and 16 are located in two side sections 19 and 20 while structures 17 and 18 are located in two end sections 21 and 22. Seating structures 15–18 put spectators in spaces that hover over and are in close proximity to action in the playing field 14. They also provide increased capacity while minimizing height above ground level and overall horizontal dimensions.

Figure 2:
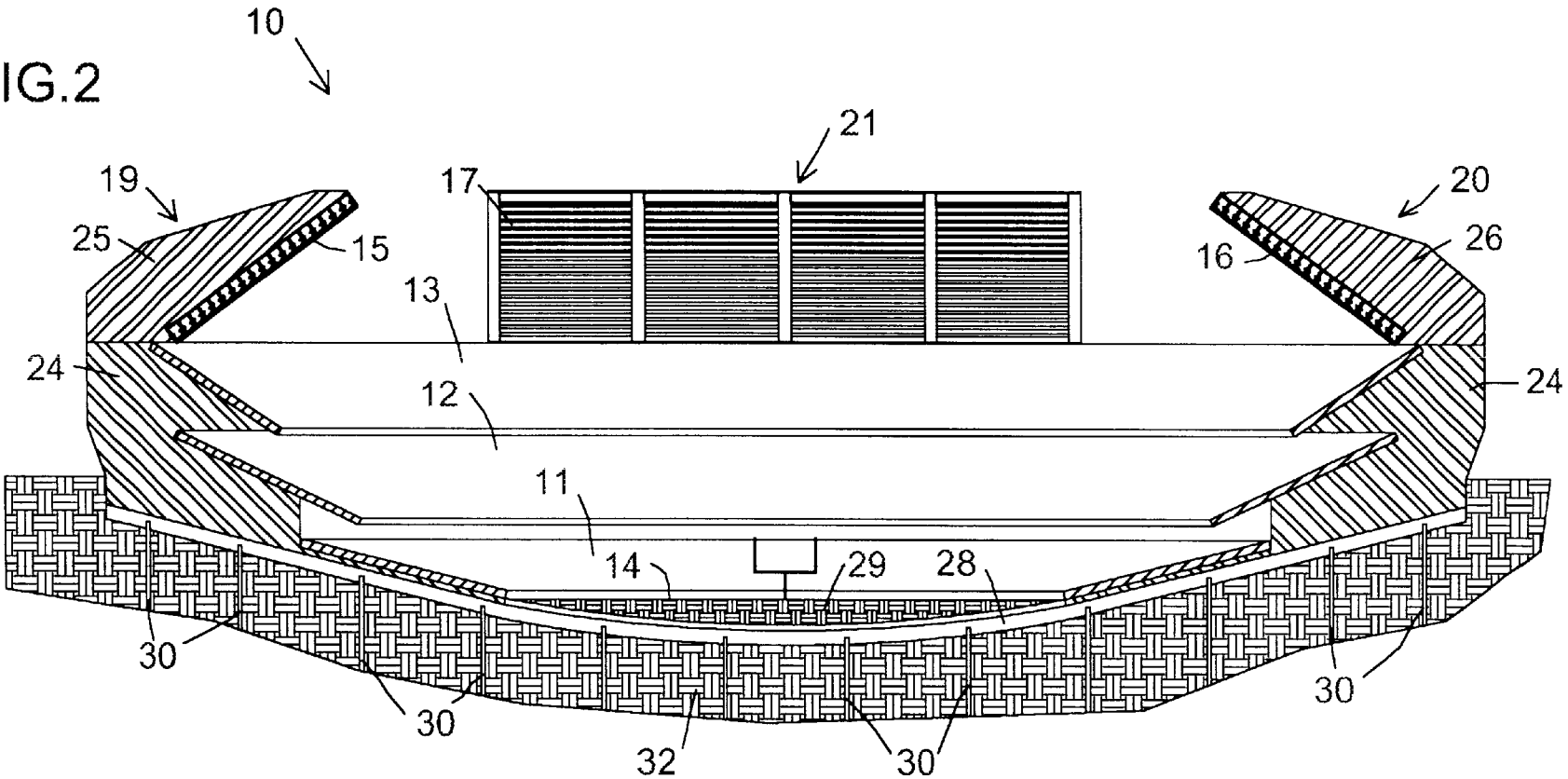
FIG. 2 is a cross-sectional view taken substantially along line 2—2 of FIG. 1.

FIG. 2 provides a cross-sectional view of seating structures 15 and 16 and an end elevational view of seating structure 17. The construction of these seating structures will be discussed in more detail. FIG. 2 also shows structures that allow the playing field 14 to be well below ground level and thereby minimize height above ground level while overcoming problems which might otherwise result. If the field is below water table, hydraulic pressures will be produced below the field and below the tiers of seats. Such pressures increase with depth and can be quite high.

The tiers 11–13 are supported by a structure 24 that is shown as being solid in the cross-sectional view of FIG. 2 but which, as will be understood, may include steel support trusses and floors and walls that provide paths for movement of spectators and players and that provide facilities such as refreshment stands, rest rooms and dressing rooms. The side sections 19 and 20 include portions 25 and 26 which support the seating structures 15 and 16 and which are supported from the structure 24 as an integral part thereof. Portions 25 and 26 are shown as being solid but it will be understood that they may include trusses and other elements, including cables, that are necessary or desirable for support of the seating structures 15 and 16 and for access of spectators thereto. The end sections 21 and 22 include portions similar to portions 25 and 26 of the side sections 19 and 20.

In the illustrated construction, a protective structure 28 is provided below the field 14 and has a peripheral portion which supports the structure 24 and thereby carries the weight of all tiers. The protective structure 28 is formed with or covered by a solid and impervious upper layer to prevent upward flow of water therethrough, allowing it to transmit any forces that may be developed from hydraulic pressure to the supporting structure 24. Any precipitation that might fall from the sky and onto the playing field 14 is removed from earth 29 immediately below the field 14, by means of sumps and pumps of conventional form, not shown.

The protective structure 28 may be formed primarily of steel but may be formed at least in part of concrete. Preferably, it is formed with a downwardly bowed configuration as shown to provide a downwardly facing arch that operates in compression to efficiently transmit upward hydraulic forces on its undersurface to the tier-supporting structure 28. The tier supporting structure 24 provides a weight that opposes forces developed from hydraulic pressure and also functions to provide a ballast which limits movements and vibrations of the seating structures 15–18 and sections 19–22 of the uppermost tier.

The total weight the structure 28 and all structures supported therefrom is preferably substantially greater than the maximum effective upward hydraulic force that can be applied to the underside of the structure 28. However, for additional opposition to upward hydraulic forces, a series of tension piles 30 are connected to the protective structure 28 and are embedded in the earth 32 that underlies the structure 28. Sumps, piping and pumps may also be provided for removing water from the earth 32 below the stadium to reduce hydraulic pressures.

Figure 3:
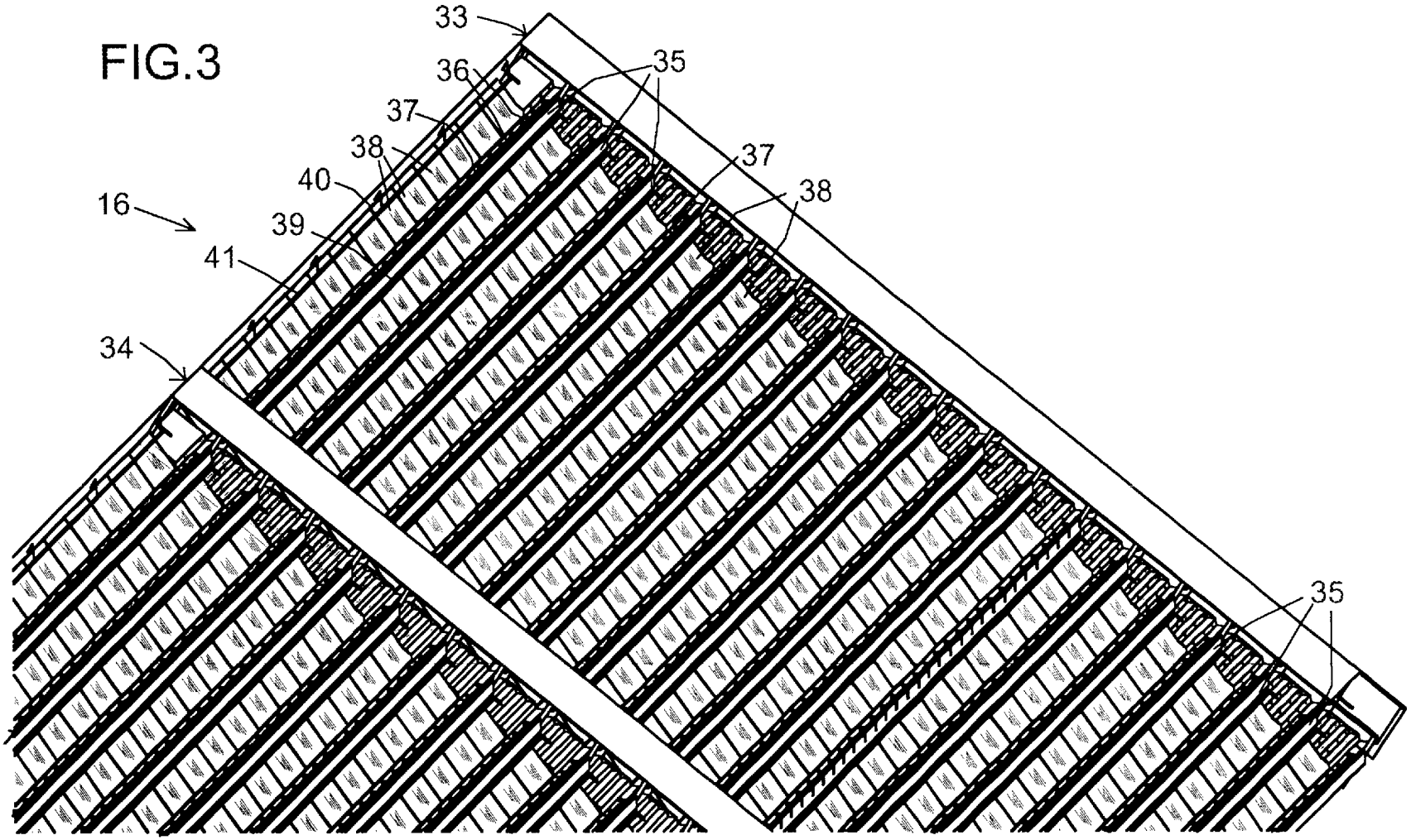
FIG. 3 is an isometric view of a portion of a seat structure of the stadium of FIGS. 1 and 2, looking from above but without showing certain support elements.
Figure 4:
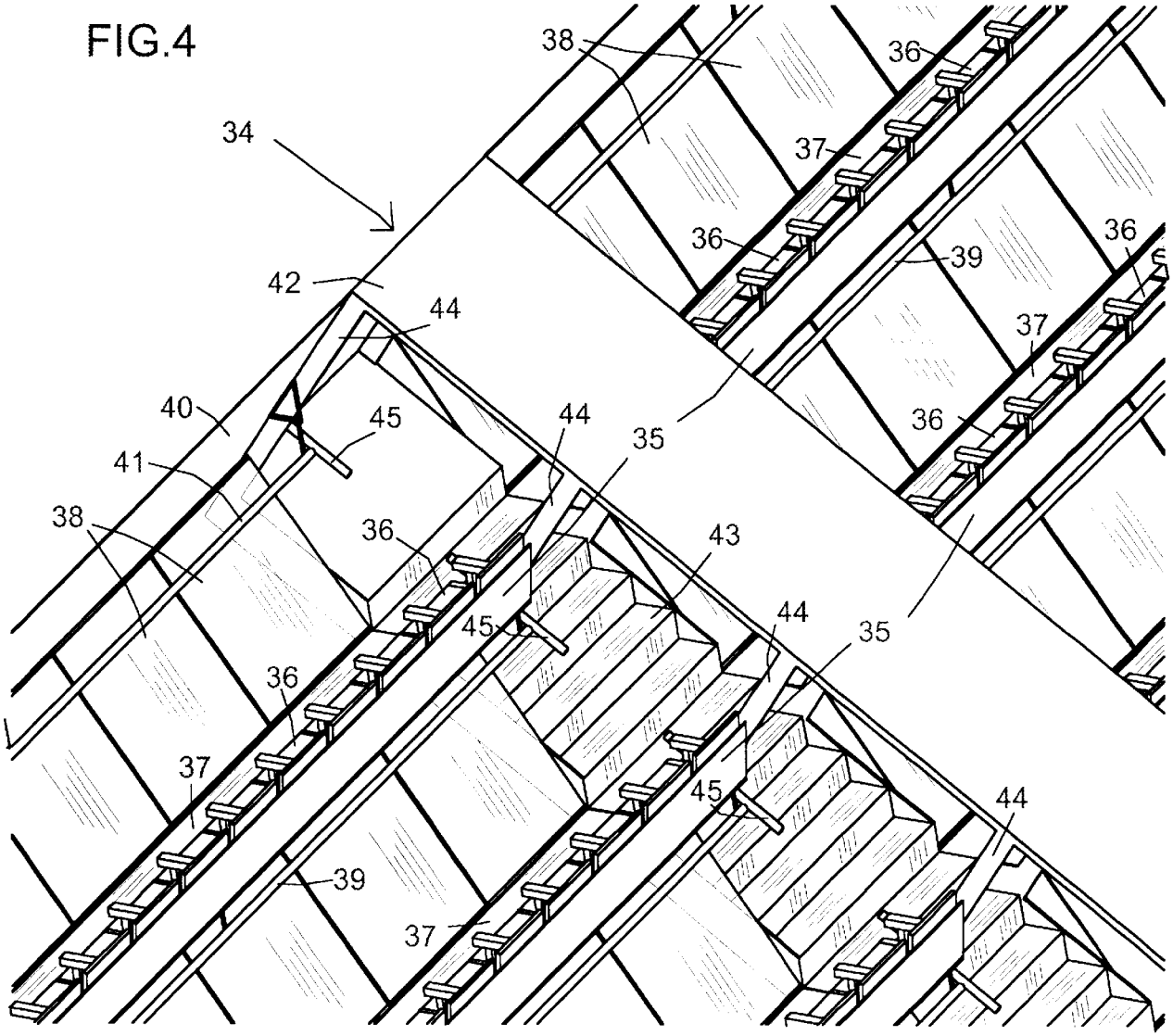
FIG. 4 is a view of a portion of FIG. 3 on an enlarged scale.

FIG. 3 is an isometric view of a portion of the seat structure 16 of the side section 20 taken from above but without showing overhead elements of the supporting portion 26 of structure 20 and connections thereto. FIG. 4 is a view of a portion of FIG. 3 on an enlarged scale. Each of the seat structures 15 and 16 of the side sections 19 and 20 includes eight parallel staircase units that are in the form of trusses and that support seven groups of seat assemblies. The seat structures 17 and 18 of the end sections 21 and 22 are of similar construction but of reduced length, each including five parallel staircase structures that support five groups of seat assemblies. In the embodiment shown in FIGS. 3 and 4, each of staircase units has ten inch wide steps and seven and one-half inch risers and is inclined upwardly at an angle of about 36.87 degrees to the horizontal. Each seat assembly may have a length of about 54 feet and each beam may have width of about 5 feet. The overall length of each of the side sections 19 and 20 may thereby be about 425 feet while the overall length of each of the end sections 21 and 22 may thereby be about 245 feet. It will be understood that these and other dimensions and numerical data that may be stated herein are provided as illustrative examples and are not to be construed as limitations.

FIG. 3 shows an end staircase unit 33 and a staircase unit 34 in spaced parallel relation to the end staircase unit 33. The enlarged scale view of FIG. 4 shows an upper portion of the beam 32 and upper portions of seat assemblies. The units 33 and 34 support the opposite ends of eighteen cross-beams 35 while unit 34 also supports the ends of eighteen cross-beams 35 extending to a next staircase unit, not shown in FIG. 3. Each cross-beam 35 supports thirty seats 36 for spectators and provides a walkway 37 for reaching the seats from the staircase units. Each cross-beam 35 also supports the lower ends of windows 38. Except for the lowermost cross-beam 35, each cross-beam 33 supports the upper ends of those of the windows 38 that extend up from the next lower cross-beam and also supports a handrail 39 usable by spectators on the walkway of the next lower cross-beam. Upper walls 40 extend between upper ends of the staircase units and support the upper ends of those of the windows 38 that are uppermost. Upper walls 40 also support handrails 41 used by spectators on the walkway 37 of the highest cross-beam 35.

In FIG. 3, the cross-beams 35 are shown at right angles to the staircase units 33 and 34 to be parallel to the longitudinal axis of the field 14. In practice, however, the cross-beams 35 may be angled rearwardly from the end staircase unit 33 and to the staircase unit 34 so that the seats will face more toward the geometric center of the field 14. This can be accomplished by offsetting the end unit 33 forwardly relative to the unit 34 while keeping both units parallel to each other and in orthogonal relation to the field 14. Offsets may be effected between other units in a manner such that all seats face more toward the center of the field 14.

Each of the illustrated staircase units 33 and 34 is in the form of a Vierendeel truss that includes an upper portion 42 each side of which is connected to a side of a lower portion 43 through a series of longitudinally spaced web members 44. The lower portion 43 is configured to provide steps as shown, every fifth step being at the same elevation as walkways provided by adjacent cross-beams. Each web member 44 may support a handrail 45 for use by spectators. The web members 44 are aligned with the seats 36 and present minimal interference with visibility of the playing field 14. Spectators in seats adjacent to the staircase units will find that the stairs interfere with visibility but that they may obtain a view of substantially all action on the field by leaning down, moving to one side or standing. The outer wall of the end staircase unit 33 is not visible in either FIG. 3 or FIG. 4 but is provided with windows for providing visibility while protecting spectators.

Figure 5:
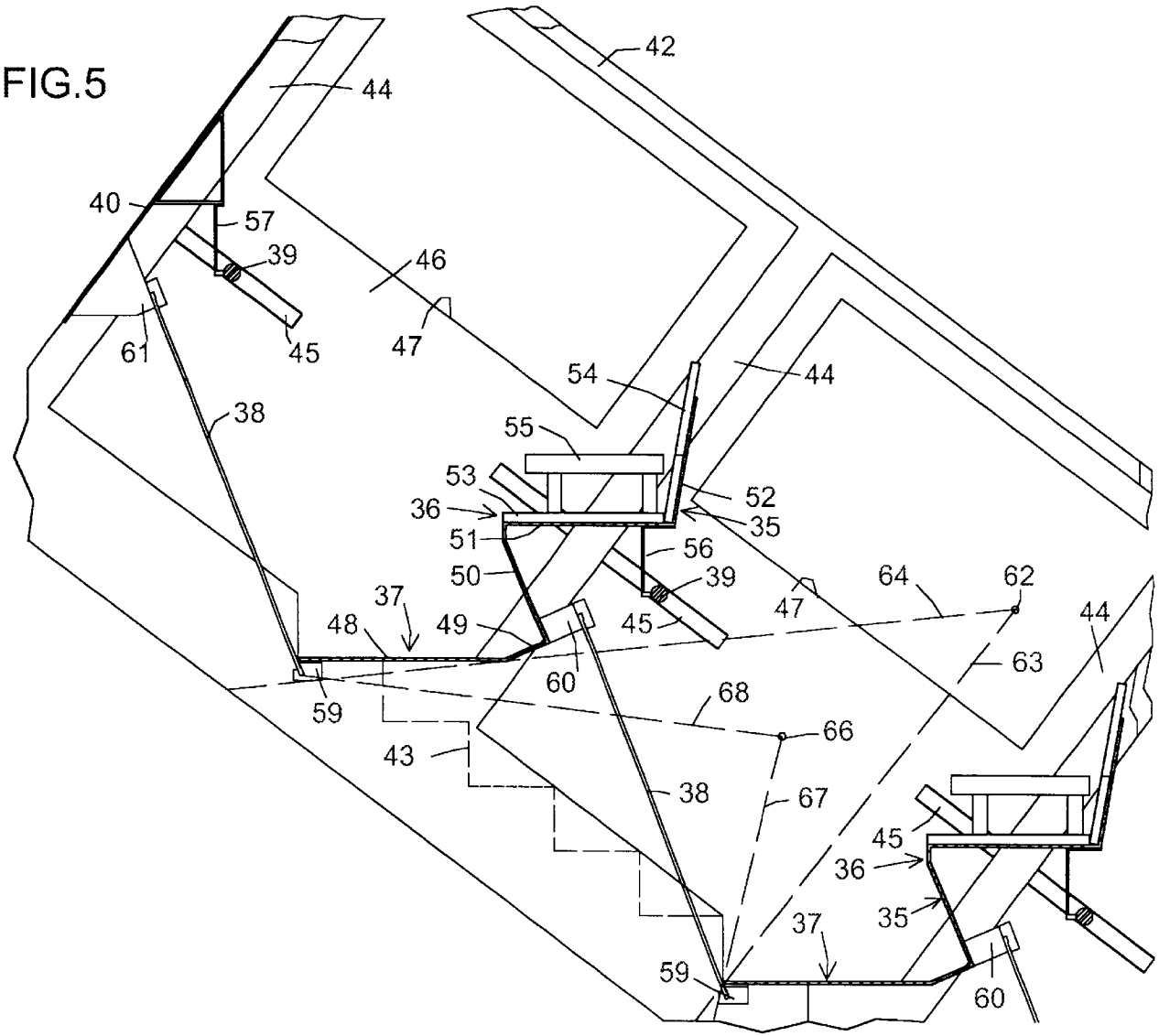
FIG. 5 is cross-sectional view of portions of the structures shown in FIG. 3.

FIG. 5 is a cross-sectional view taken through the an upper wall 40 and the upper two cross-beams 35 between the staircase units 33 and 34, looking toward the end staircase unit 33. In this view, an outer wall 46 is visible and is formed with openings 47 which may be either open or glazed. This view also shows in dotted lines the location of the steps formed in the lower wall 43 of the end staircase unit 33.

As shown in FIG. 5, each of the cross-beams 35 has a horizontal portion 48 which provides the walkway 37, a portion 49 that extends rearwardly and upwardly from the rear end of walkway portion 48, a portion 50 that extends forwardly and upwardly from the portion 49, a horizontal seat portion 51 that extends rearwardly from the upper end of portion 50 and a back portion 52 that extends upwardly and rearwardly from the rear end of the seat portion 51. Portions 49 and 50, positioned as shown allow the feet of seated spectators to be moved rearwardly when others are on the walkway portion 48. The angular position of portion 49 is such that it will not interfere with vision by a spectator on the next lower level.

The configuration of the beams 35 as illustrated provides a high degree of strength and rigidity as well as facilitating installation of the seats, providing a walkway and supporting handrails and windows. In installing seats, cushions 53 and 54 of the seats 36 are secured to the seat and back portions 51 and 52. An arm 55 is provided on each side of each seat. For supporting the handrails 39, brackets 56 are secured in spaced relation along the underside of the seat portion 51 of all of the cross-beams 35 except the lowermost. For supporting the uppermost handrails 41, brackets 57 are similarly supported from the upper walls 40.

The lower ends of all of the windows 38 are supported in slots in fixtures 59 that are located on the underside and adjacent the forward edge of the walkway portion 48 of each cross-beam 35. Except for the uppermost windows, the upper ends of the windows 38 are supported by brackets 60 that are secured to the rear sides of the portions 50 of the cross-beams. The upper ends of the upper windows are supported by similar brackets 61 from the upper walls 40.

In the stadium application as illustrated, it is desirable that sounds from the field and from other spectators be heard by each spectator and also that cheers of each spectator be heard along with cheers from others. The windows 38 may preferably be of glass and most preferably of tempered glass that can withstand any forces that might be inadvertently or otherwise applied by spectators. To provide for sound transmission using glass windows, the brackets 60 and 61 are preferably located in spaced relation along the cross-beams 35 and upper walls 40 to provide substantial spaces therebetween. In addition, spaces may be provided between adjacent windows. For example, each window 38 may have a width which is somewhat less than the width of two seats, providing spaces sufficient for sound transmission. It is also noted that the windows 38 may be in the form of screens such as may be formed with stainless steel wires with a fine mesh that does not interfere with visibility and with a strength that is more than adequate. The use of windows in the form of screens avoids any problem with sound transmission but has the potential disadvantage that liquids may be spilled therethrough to fall onto spectators below. However, windows in the form of screens might be the best choice in certain applications, for example in seating structures for concert halls where spilling of liquids would be very unlikely and where sound transmission is particularly important.

An important consideration is the degree to which action on the field 14 can be viewed by each spectator. In FIG. 5, reference numeral 62 indicates the typical normal position of the eyes of a spectator at the next to highest level, permitting the spectator to view any action between viewing angles indicated by dashed lines 63 and 64. From the eye position 62, viewing at a angle less than that of line 63 is limited by the front edge of the walkway portion 48. Viewing at an angle greater than that of line 64 is limited by the rearward edge of the walkway portion. However, the spectator can easily achieve a much greater range of viewing angles simply by leaning forward to obtain an eye position indicated by reference numeral 66 and to obtain minimum and maximum viewing angles as indicated by dashed lines 67 and 68.

In this illustration, the angular range from the normal position 62 is from 6 to 52 degrees. From the forward position 66, the range is from minus 7 to 76 degrees. The conditions have been analyzed when the field 14 is a football field having a standard width of 160 feet when the lower end of the staircase units are at positions 250 feet horizontally and 107 feet vertically from the center of the field 14. The angular range required to see 35 feet beyond each of the near and far sidelines is from 16 to 38 degrees at the lowest level and is from 29 to 70 degrees at the highest level. Thus at the lowest level, there is no problem with visibility. At the highest level, it is necessary to lean forwardly to see the complete region 35 feet in from the near sideline, but only to the extent required to increase the angle from 52 to 70 degrees. To see the near sideline, it is only necessary to increase the angle from 52 to 60 degrees. Leaning forwardly as necessary should not be a problem. It is expected that it will occur naturally and without conscious thought in following actions on the field.

Figure 6:
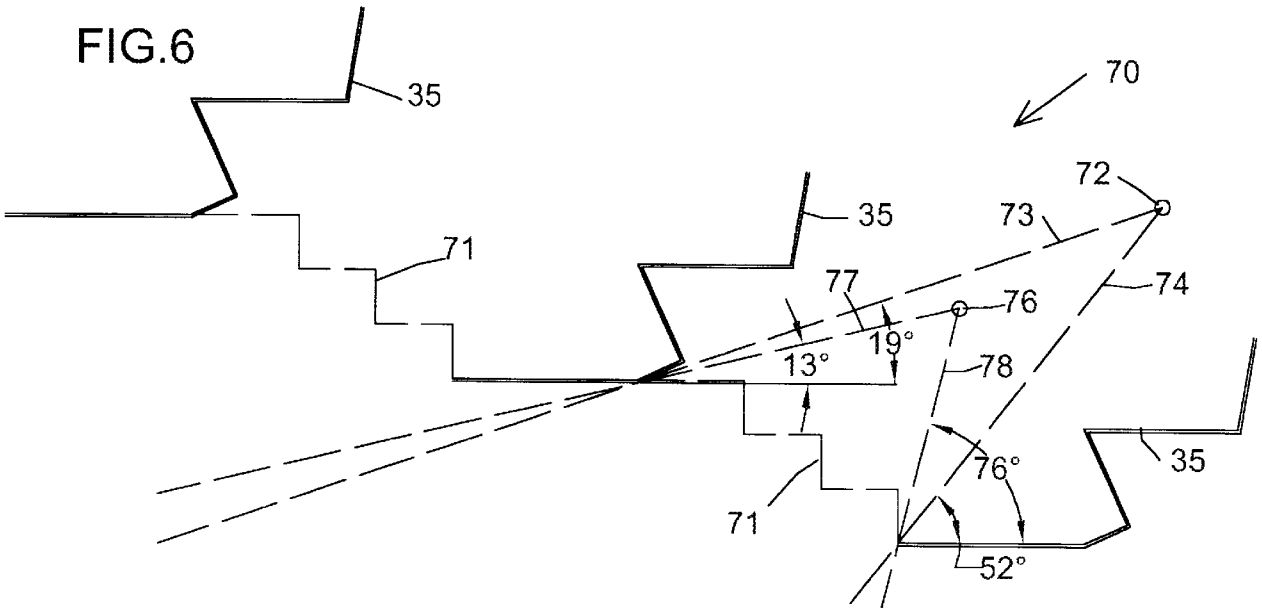
FIG. 6 illustrates an embodiment usable as an alternative to that shown in FIGS. 1–5.

In the illustrated construction, the staircase units 33 and 34 are at an angle of 36.87 degrees. It is possible to substantially reduce the angle in order to reduce the overall height. FIG. 6 illustrates an embodiment generally indicated by reference numeral 70 in which the angle is reduced to about 20 degrees. In this embodiment, the horizontal and vertical spacings of each cross-beam 35 except the lowermost with respect to the next lower cross-beam are respectively 58 inches and 21 inches. As indicated by dashed lines 71, three seven inch steps are provided for moving from each level to the next higher level, resulting in a landing area of substantial length at each level. The construction is otherwise substantially the same as that of the first embodiment, the positions and dimensions of windows, brackets and other components being appropriately adjusted.

Figure 7:
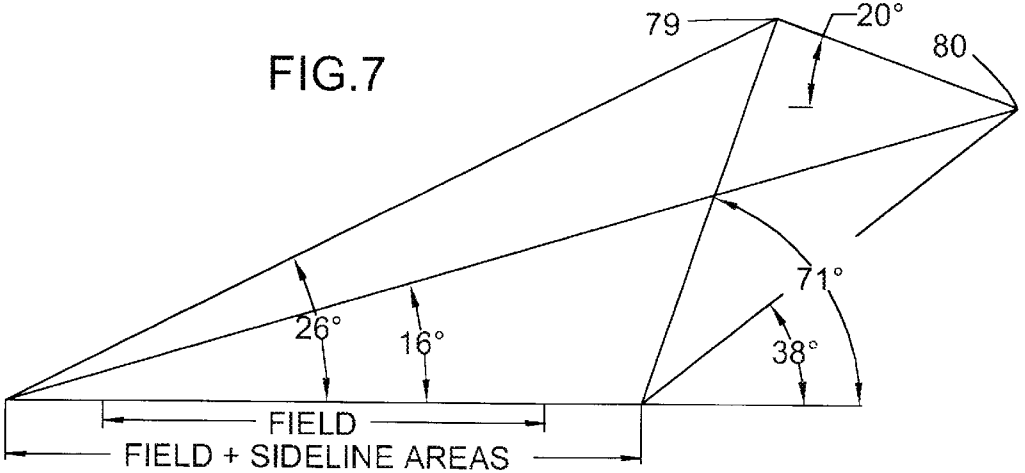
FIG. 7 is a diagram showing ranges of viewing angles, for explanation of FIG. 6 and of principles of the invention.

In FIG. 6, the viewing angles from a normal position 72 are indicated by lines 73 and 74. The viewing angles from a forward position 76 are indicated by lines 77 and 78. FIG. 7 is a diagram showing the ranges of viewing angles required to see the field and adjacent sideline areas. Eighteen levels are assumed. At the highest level indicated by point 79, the range of the required viewing angles is from 26 to 71 degrees. At the lowest level indicated by point 80, the range is from 16 to 38 degrees. With reference to FIG. 6, it can be seen that at the highest level and in looking at the near sideline area, a moderate forward movement from the normal position 72 toward the forward position 76 is required to increase the angle from the 52 degree angle of line 74 to obtain the required 71 degrees. At the lowest level and in looking at the far sideline area, a moderate forward movement is required to reduce the angle from the 19 degree angle of line 73 to obtain the required 16 degrees. Thus forward movements may be required when looking at the near sideline area, especially when at the highest level, and when looking at the far sideline area, especially when at the lowest level. However, such required movements are of only moderate magnitude.

At positions that are lower and away from the field, a larger horizontal spacing of cross-beams is desirable for viewing of the far side line and adjacent area. However, as the viewing position is moved upwardly and toward the field, viewing of the far side line and adjacent area becomes less and less critical and it is possible to decrease the horizontal spacing without any adverse effect. Thus the horizontal spacing may advantageously be reduced as a function of the distance from the lower end. It is also possible to change the vertical spacings alone or both horizontal and vertical spacings to obtain similar advantages. However, if vertical spacings are changed care must be taken in selecting the height of stair risers to satisfy code requirements.

Figure 8:
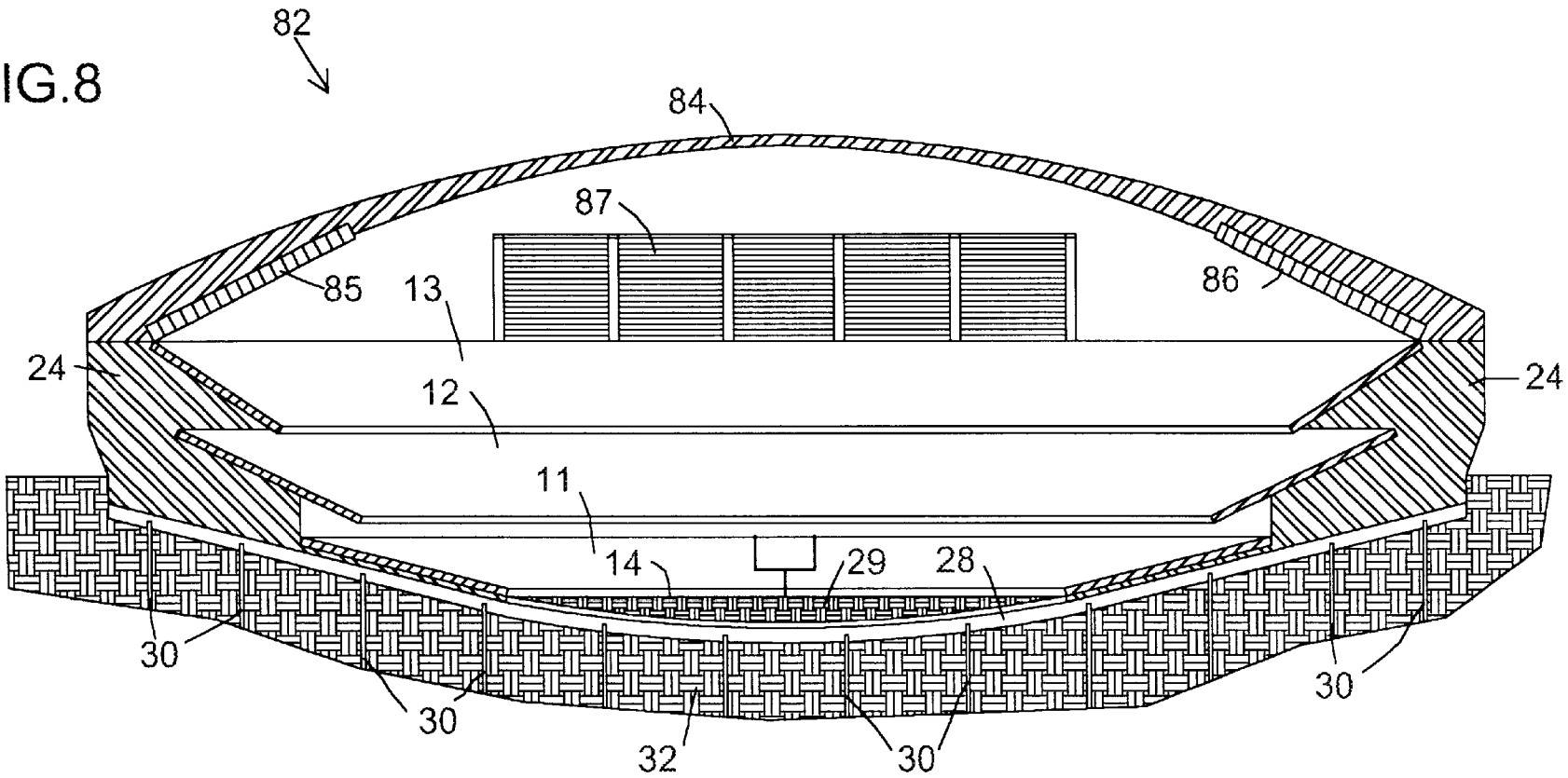
FIG. 8 is a cross-sectional view similar to FIG. 2 but showing an alternative embodiment that has a roof.

FIG. 8 is a cross-sectional view similar to FIG. 2 but showing a stadium 82 in which a dome-shaped roof structure 84 replaces the supporting structures 25 and 26 of the side sections 19 and 20 and corresponding supporting structures of the end sections 21 and 22. Two side seat structures 85 and 86 replace the seat structures 15 and 16, an end seat structure 87 replaces the end seat structure 17 and another end seat structure, not shown, replaces the end seat structure 18. These seat structures of the stadium 82 are constructed like those of the stadium 10 but have a reduced slope. The use of a roof structure has advantages in being usable in all weather conditions and has an important additional advantage when combined with reversely sloped seat structures. The roof 84 provides support of the seat structures, avoiding the cantilever support used in the stadium 10. At the same time, the seat structures help support the roof 84.

It will be understood that modifications and variations may be effected without departing from the spirit and scope of the novel concepts of the invention.

What is claimed is:

1. A seating tier comprising: a plurality of rows of seats for spectators supported at progressively higher levels in relation to a view region, the lowermost of said rows being spaced upwardly and horizontally away from said view region, and each other row being closer than the next lower row to said view region.

2. A seating tier as defined in claim 1, further comprising walkways along the fronts of said rows of seats for allowing spectators to reach said seats.

3. A seating tier as defined in claim 1, further comprising windows adjacent said walkways and between said seats and said view region for allowing viewing of said view region while preventing movement of spectators through said windows.

4. A seating tier as defined in claim 3, wherein said windows are of a solid transparent material.

5. A seating tier as defined in claim 4, wherein said windows are supported to provide openings for transmission of sound between said view region and spectators in said seats.

6. A seating tier as defined in claim 2, including stairways allowing spectators to reach ends of said walkways.

7. A seating tier as defined in claim 1, further comprising a plurality of cross-beams in spaced parallel relation for support of said rows of seats.

8. A seating tier as defined in claim 7, wherein each of said cross-beams includes a first portion extending horizontally to define a walkway, a second portion extending upwardly from a rearward end of said first portion, a third portion extending rearwardly from an upper end of said second portion for support of a row of said seats, and a fourth portion extending upwardly from a rearward end of said third portion for support of back portions of said row of seats.

9. A seating tier as defined in claim 8, further comprising handrails supported from said cross-beams for use by spectators walking on said walkways.

10. A seating tier as defined in claim 8, wherein upper limits of fields of view of spectators are defined by said rearward ends of said first portions of said cross-beams, said second portions of said cross-beams being angled rearwardly and upwardly and then forwardly and upwardly to forward sides of said third portions to avoid limiting of said fields of view while allowing spectators to move their feet rearwardly.

11. A seating tier as defined in claim 7, further a comprising plurality of stairway units that are in spaced parallel relation and that extend upwardly along the ends of said cross-beams for support of said cross-beams.

12. A seating tier as defined in claim 11, wherein each of said stairway units includes lower portion formed to provide steps for reaching said rows of seats, an upper portion in spaced relation above said lower portion, and web portions connecting opposite sides of said lower and upper portions, said web portions being aligned with said cross-beams.

13. A seating tier as defined in claim 12, handrails supported on said web portions.

14. A stadium including a playing field and lower tiers of seats that extend upwardly and away from said playing field, said stadium further including an upper tier that comprises a plurality of rows of seats for spectators supported at progressively higher levels in relation to said playing field. the lowermost of said rows being spaced upwardly and horizontally away from said playing field, and each other row being closer than the next lower row to said playing field.

15. A stadium as defined in claim 14, wherein support means are provided that support said rows of seats and that provide walkways for use by spectators to reach said seats, wherein lower sides of said support means are effective to provide upper limits on fields of view of said playing field by spectators, and wherein forward sides of said walkways are effective to provide lower limits on the said fields of view of said playing field by spectators, said fields of view being thereby increased as the eyes of spectators are moved forwardly and downwardly toward said field, the horizontal and vertical spacings of said support means being such as to minimize forward and downward movements of eyes of spectators when viewing actions on said field and on areas adjacent to said field.

16. A stadium as defined in claim 14, further comprising support means for said tiers of seats, and a protective structure that underlies said playing field and said support means, said protective structure being impervious to flow of water therethrough and being effective to transmit to said support means any hydraulic forces that are applied to the underside of said protective structure.

17. A stadium as defined in claim 14, including a dome-shaped roof over said upper tier of seats.

18. A stadium as defined in claim 17, wherein three additional upper tiers of seats are provided under said roof, each of said additional upper tiers comprising a plurality of rows of seats for spectators supported at progressively higher levels in relation to said playing field, the lowermost of said rows of each additional upper tier being spaced upwardly and horizontally away from said playing field, and each other row of each additional tier being closer than the next lower row to said playing field two of said tiers being in side portions of said stadium.

19. A stadium as defined in claim 18, wherein each of said upper tiers is supported by said roof and provides support for said roof.

* * * * *